United States Patent [19]

Sukolics et al.

[11] 4,030,260

[45] June 21, 1977

[54] WALL CONSTRUCTION

[75] Inventors: Ronald D. Sukolics, Elkhart, Ind.; Lawrence F. Biebuyck, Dallas, Tex.

[73] Assignee: Kawneer Company, Inc., Niles, Mich.

[22] Filed: Nov. 26, 1975

[21] Appl. No.: 635,761

Related U.S. Application Data

[63] Continuation of Ser. No. 539,299, Jan. 8, 1975, abandoned.

[52] U.S. Cl. ..... 52/397; 52/238; 52/209

[51] Int. Cl.[2] ..... E04B 1/62; E04H 1/00

[58] Field of Search ..... 52/209, 397, 238, 302, 52/303, 588

[56] References Cited

UNITED STATES PATENTS

| | | | |
|---|---|---|---|
| 2,933,779 | 4/1960 | Delaroche | 52/302 |
| 3,221,453 | 12/1965 | Lietaert | 52/209 |
| 3,358,410 | 12/1967 | Dawdy et al. | 52/238 |
| 3,359,022 | 12/1967 | Russell | 52/238 |
| 3,858,375 | 1/1975 | Silvernail | 52/209 |
| 3,866,369 | 2/1975 | Paull | 52/209 |

FOREIGN PATENTS OR APPLICATIONS

| | | | |
|---|---|---|---|
| 256,490 | 11/1963 | Australia | 52/588 |

*Primary Examiner*—Price C. Faw, Jr.
*Assistant Examiner*—Robert C. Farber
*Attorney, Agent, or Firm*—Mason, Kolehmainen, Rathburn & Wyss

[57] ABSTRACT

A wall construction includes a plurality of panel members and joining elements therefor. The panel members are provided with spaced apart inside and outside face elements and edge members along opposite longitudinal sides for interconnection with adjacent panels or corner posts. Foamed in place insulating material is provided between the inside and outside face elements of the panels between the edge members. The outside face elements of the panels are formed by modular width members of weather resistant sheet material having a plurality of spaced apart longitudinal grooves in the outer surface. Tongue and groove means along longitudinal edges of the face elements are interfitted with tongue and groove means in the panel edge members in a manner forming a groove on the outside face of the panel similar and parallel to the grooves in the outside face elements. Edge members of the panels include an outside element, an inside element and a glazing pocket formed therebetween. A joining element or corner element is provided to interconnect adjacent panels of the wall construction set in place and no separately visible independent mullions are required.

28 Claims, 16 Drawing Figures

44L
46
50
52
48
84
90
64
88
42
40
37
56
78
66
52
50
48
46
38
36
58
54L
44R
38
90
64
78
84
88
82
66
80
82
62
60
35
34
35
60
62
54R
30
80

Fig. 8
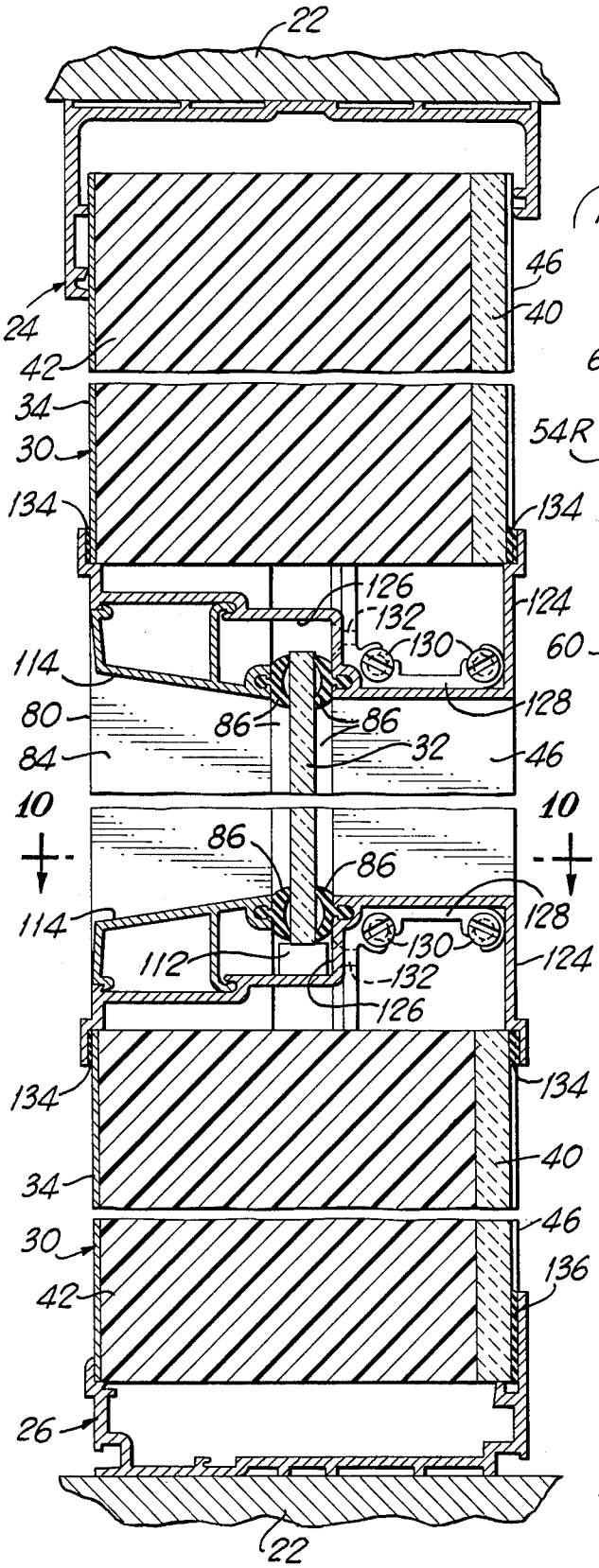
Fig. 9
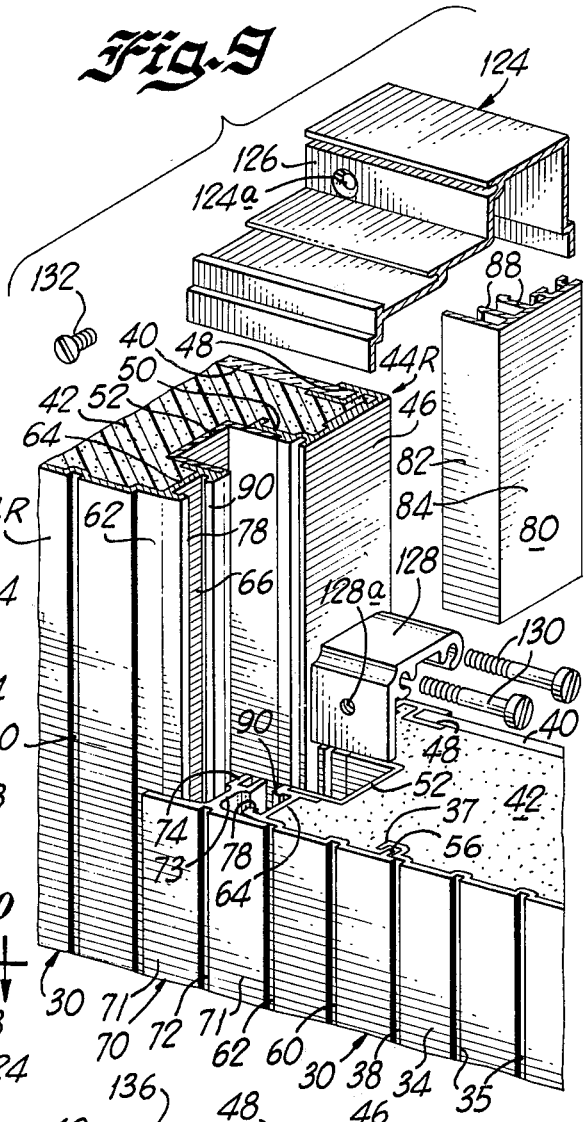
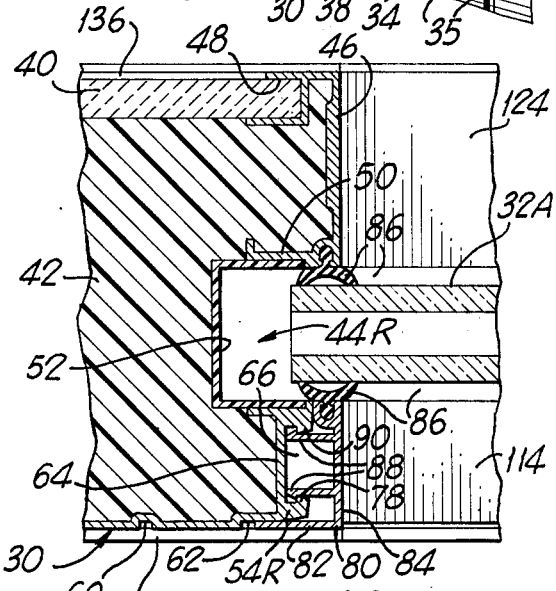
Fig. 10

WALL CONSTRUCTION

This is a continuation of copending application Ser. No. 539,299, filed Jan. 8, 1975 now abandoned.

The present invention relates to a new and improved wall construction and more particularly to a new and improved wall construction employing a plurality of novel panel members which are structurally self supporting so that no separate or individual mullions are required. Normally, mullions are required and stand out in appearance, however, in the novel wall construction herein, such mullions are eliminated and the joinery for the panels is similar to the appearance of the panels themselves.

It is an object of the present invention to provide a new and improved wall construction.

More specifically, it is an object of the present invention to provide a new and improved wall construction employing novel structural panel members adapted to be set up in side by side relation and rapidly interconnected together to form a wall without requiring the use of separate structural mullions between the edges of the panels as in prior art systems.

Yet another object of the present invention is to provide a new and improved wall construction including a novel structural panel member which is comparable with many existing wall constructions employing mullions and glazing panels.

Another object of the invention is to provide a new and improved wall construction employing a novel panel member wherein structural members are integrated into the edge structure of the panel and wherein the edge structure is well adapted for supporting an adjacent glazing panel or the like or another panel positioned adjacent thereto.

Yet another object of the present invention is to provide a new and improved wall construction employing panel members having outside faces with longitudinal grooves therein formed by one or more face elements of a modular width.

Another object of the invention is to provide a new and improved panel which may be fabricated with any number of modular width face elements to provide almost any selected panel width.

Yet another object of the present invention is to provide a new and improved wall construction including the panel members having inside and outside faces of structural material including extruded aluminum elements and the like which have excellent weathering characteristics and are also suitable for taking structural loads.

Yet another object of the present invention is to provide a new and improved wall construction including panel members having an insulating body of material between inside and outside faces to provide excellent thermal characteristics as well as good structural strength for the panel.

The foregoing and other objects and advantages of the present invention are accomplished in an illustrated embodiment by way of representation and not limitation wherein a novel wall construction includes panel members having spaced apart inside and outside faces and edge members along opposite longitudinal sides of the panel between the faces. The inside and outside faces are separated by an insulating body of foam to provide structural integrity and excellent insulating characteristics. The outside face comprises one or more elements of weather resistant sheet material having a plurality of spaced apart longitudinal grooves formed in the outer surface thereof and tongue and groove means along opposite longitudinal edges interfitted with tongue and groove means in adjacent elements or edge members of the panels. These tongue and groove joints on the outside face of the panel are parallel and similar to the grooves formed in the face elements. The edge members comprise outside elements of generally angular cross-section having outside legs with tongue and groove means for connection with the outside face elements and a transverse leg extending inwardly of the outer panel face. An inside element includes a leg extending transversely outwardly of the inside face of the panel and interconnected therewith. A glazing pocket of channel-shaped cross section having spaced apart legs on opposite sides and a web portion transverse to the panel face is interconnected with the transverse leg of the outside element and the leg of the inside element to complete the edge member. Novel joinery means is provided for joining the edges of adjacent panels in co-planar relation or joining a panel and a corner post. The joinery element includes an outside strip adapted to provide an interfitting tongue and groove joint with the edge members of a panel or a corner post.

For better understanding of the present invention reference should be had to the following detailed description taken in conjunction with the drawings, in which:

FIG. 8 is a vertical cross-sectional view taken substantially along lines 8—8 of FIG. 1;

FIG. 9 is a fragmentary, exploded, perspective view from the outside of the wall construction illustrating components adjacent the lower corner of an opening provided for a glazing panel in the wall construction;

FIG. 10 is a horizontal fragmentary cross-sectional view taken substantially along lines 10—10 of FIG. 8;

Figure 1:
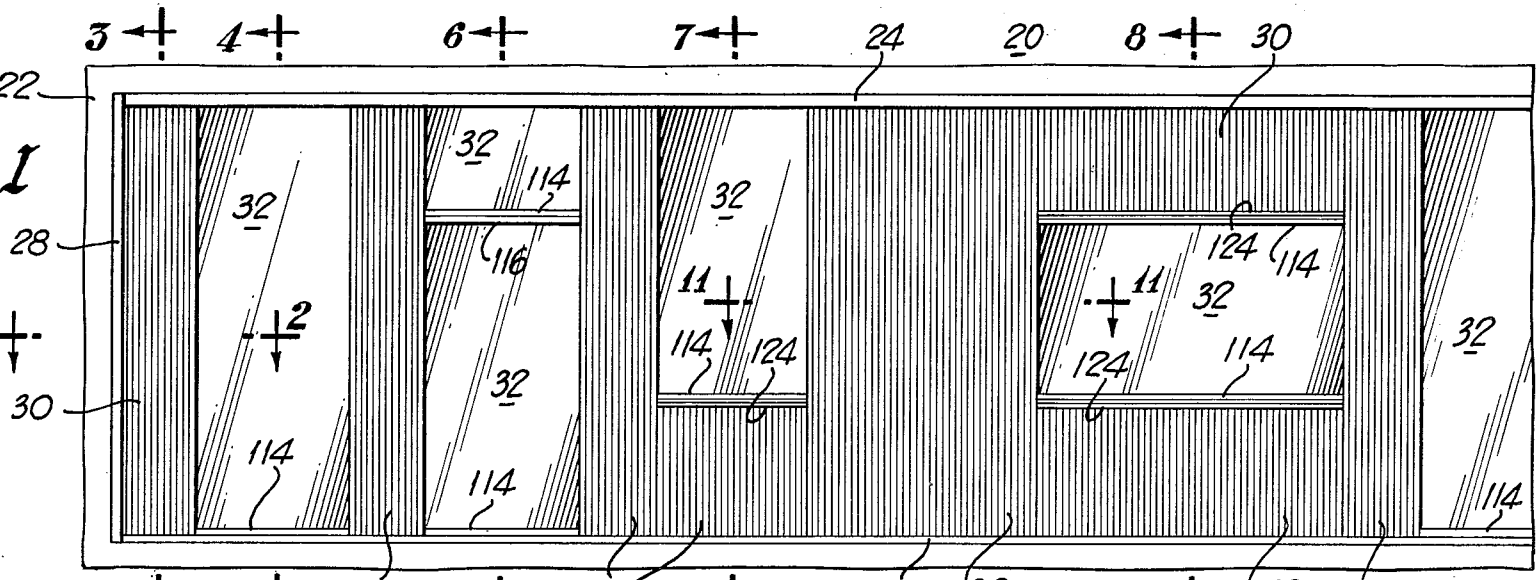
FIG. 1 is an outside elevational view of a new and improved wall construction constructed in accordance with the features of the present invention.

Referring now more particularly to the drawings, in FIG. 1 there is illustrated a new and improved wall construction in accordance with the features of the present invention and referred to generally by the reference numeral 20. The wall construction is adapted to enclose a relatively large opening in a building wall structure 22 and the opening is framed by an upper plate 24, a lower sill 26, and one or more vertical side members 28. The wall construction 20 may include in varied combination a plurality of panels 30 of varying widths and heights along with a plurality of relatively thin glazing panels 32 of varying widths, heights and thickness interfitted in a variety of different arrangements.

Figure 2:
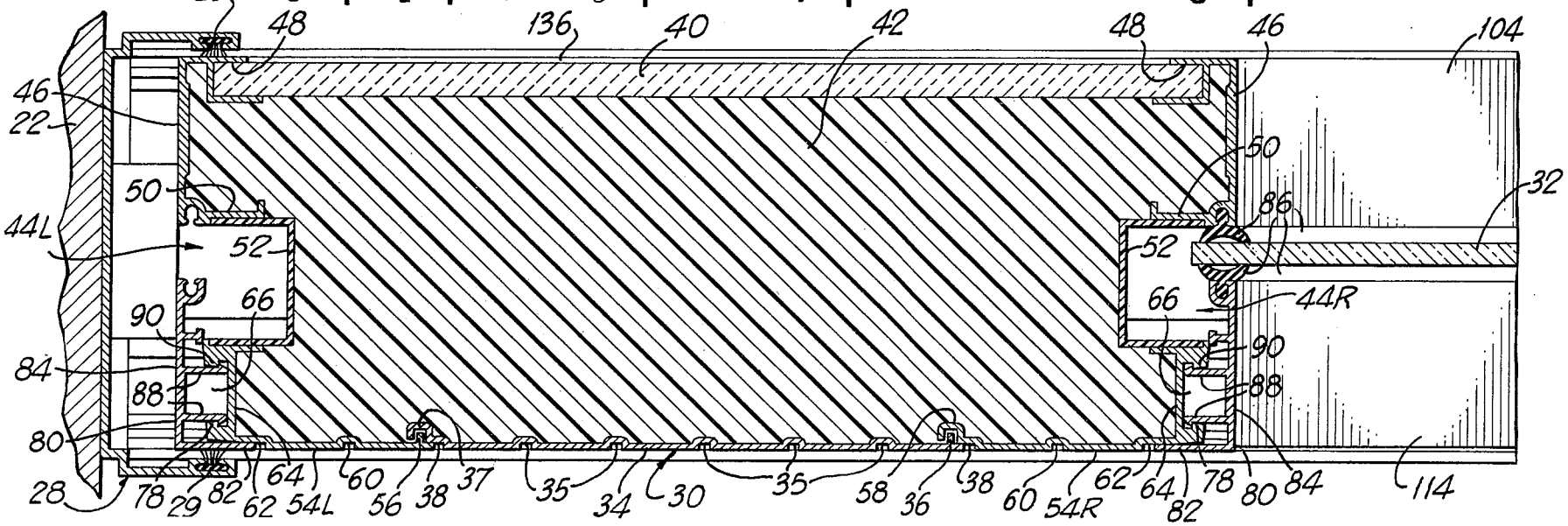
FIG. 2 is a horizontal fragmentary cross-sectional view taken substantially along lines 2—2 of FIG. 1.
Figure 3:
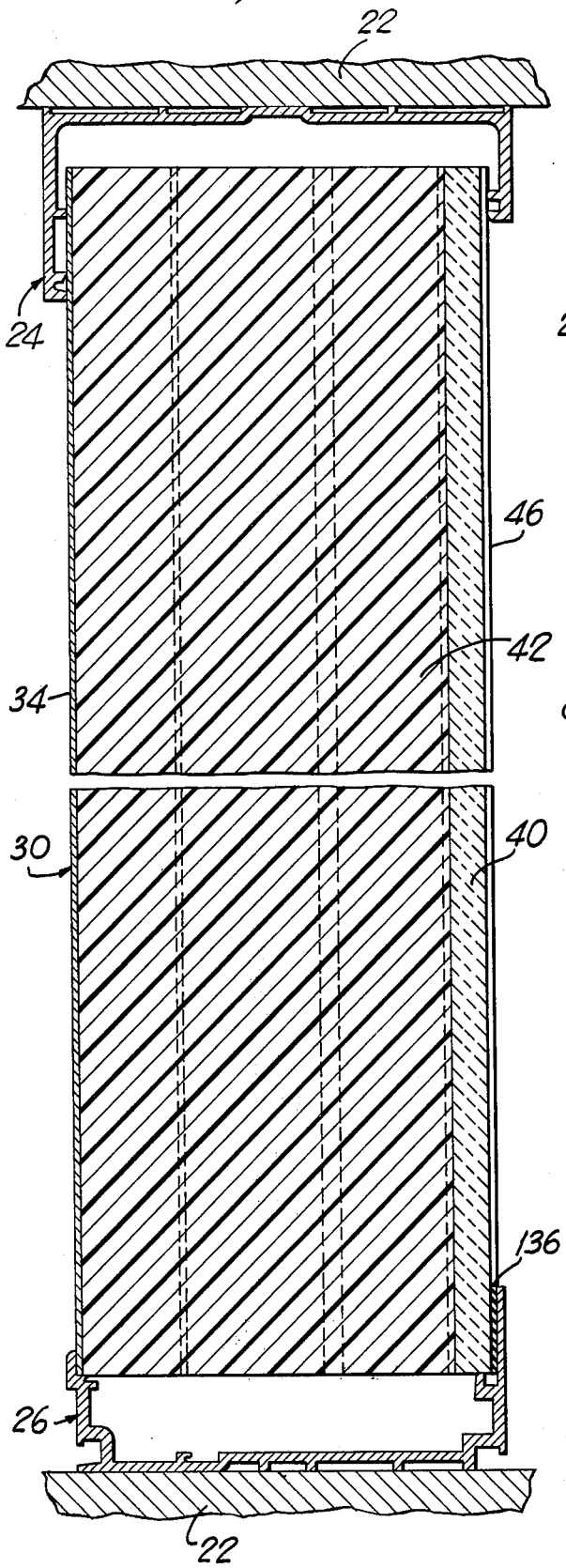
FIG. 3 is a vertical cross-sectional view taken through a wall panel substantially along lines 3—3 of FIG. 1.

As best shown in FIGS. 3, 4, 7 and 8, the panels 30 are structural and are of substantial thickness. The lower ends of the panels are seated in and supported on the channel-shaped, lower sills 26 and the upper ends of the panels extend upwardly between a pair of downwardly depending legs of the channel-shaped upper plate 24 as best shown in FIGS. 3 and 8. Referring to FIG. 2, the longitudinal edges of the panel members 30 are adapted to extend between the opposite legs of the channel-shaped side member 28 and appropriate seals 29 are provided between the legs of the side channel and the outside and inside surfaces of the panel 30 inserted therebetween, as shown.

Figure 11:
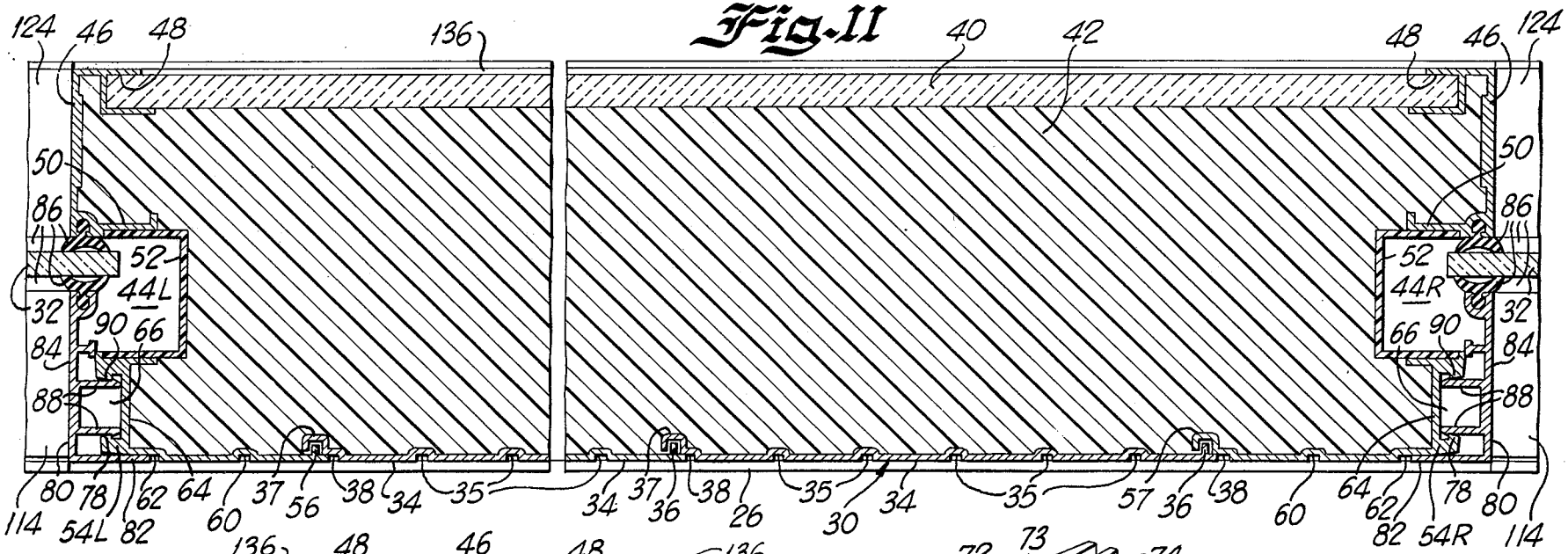
FIG. 11 is a horizontal cross-sectional view taken substantially along the lines 11—11 of FIG. 1.

Referring to FIGS. 1, 2, 5 and 11, the structural panels are constructed in various widths and lengths and each includes an outer side face or cover formed of one or more modular outside face elements 34 of a selected standardized width (for example, 6 inches). The elements are formed with a plurality of longitudinally extending, spaced apart, parallel grooves 35 in the outer face thereof. In order to provide for panels of different widths, different numbers of the face elements 34 may be used in combination and these elements are interconnected together along opposite longitudinal edges as best shown in FIG. 11 by means of tongue and groove connectors including inwardly extending tongues 36 along one longitudinal edge of an element and an inwardly projecting groove structure 37 along the opposite edge. The modular face elements are constructed with outwardly facing recesses 38 along their edge adjacent the tongue 36 in order to provide an edge groove 38 when an adjoining face element is interconnected. The outwardly facing grooves 38 appear similar to and are spaced evenly apart from the grooves 35 formed in the face of the elements 34. Each panel is provided with an inside face member 40 preferably formed in a single piece of suitable sheet material such as hard board, gypsum board, plywood, sheet metal and the like. The inside and outside faces are structurally interconnected by means of an insulating body 42 of substantial thickness. Preferably, the insulating body is foamed in place, polyurethane material, which material is relatively strong for a foam and which provides excellent heat insulating characteristics.

Figure 12:
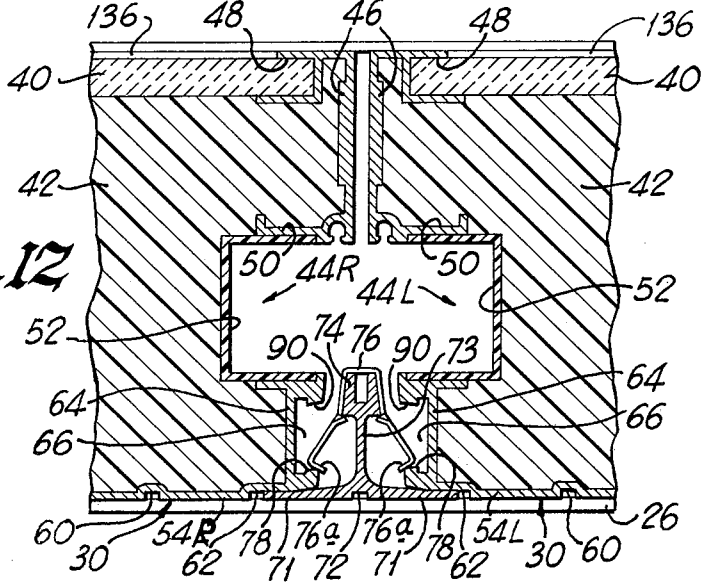
FIG. 12 is a fragmentary horizontal cross-sectional view illustrating the joining system for interconnecting adjacent edges of a pair of panels side by side in the wall construction.

As most graphically shown in FIG. 12, the opposite longitudinal edge portions of the structural panels 30 are provided with right and left hand edge assemblies, indicated generally by the numerals 44L and 44R, respectively, and these edge assemblies facilitate the interconnection of adjacent panels in side by side relation, or the interconnection of the panels with glazing panels and or corner posts. The edge assemblies include identical inside corner elements 46 of generally channel-shaped cross-section and each element includes a web or body portion extending transversely of the inside face member 40. The inside corner elements include a channel-shaped groove structure 48 along the inside edge for receiving a marginal edge portion of the inside face member 40 and also include an opposite leg parallel of the panel faces and interconnected against and backing up one side flange of a channel-shaped member 52 formed of extruded vinyl or other plastic insulating material to provide a glazing pocket for receiving the edge of a glazing panel 32. The opposite side flange of the glazing pocket channel 52 is joined with the inner edge of an outside corner element 54L or 54R. The outside corner elements are generally of angular shaped cross-section and are different from one another in that the left hand element 54L is provided with an inwardly extending tongue 56 adapted to seat within a groove structure 37 of an inner connected modular panel face element 34. The opposite corner element 54R is provided with a groove structure 57 adapted to interfit with a tongue 36 of an interconnecting modular face element 34. The outside corner elements 54L and 54R each include an outer leg having longitudinal grooves 60 in the outer surface thereof spaced parallel and substantially similar in appearance to the grooves 35 in the outside modular face elements 34. Adjacent the outer edge of the elements 54L and 54R there is provided a shoulder recess 62 in which is seated a joining element or a glazing stop when the panels are assembled together as will be described hereinafter.

The elements 54L and 54R also include transversely inwardly extending legs 64 parallel of the main body portion of the inside elements 46 but offset therefrom to provide an outer corner pocket 66 facing outwardly of the panel along the longitudinal edge.

Figure 13:
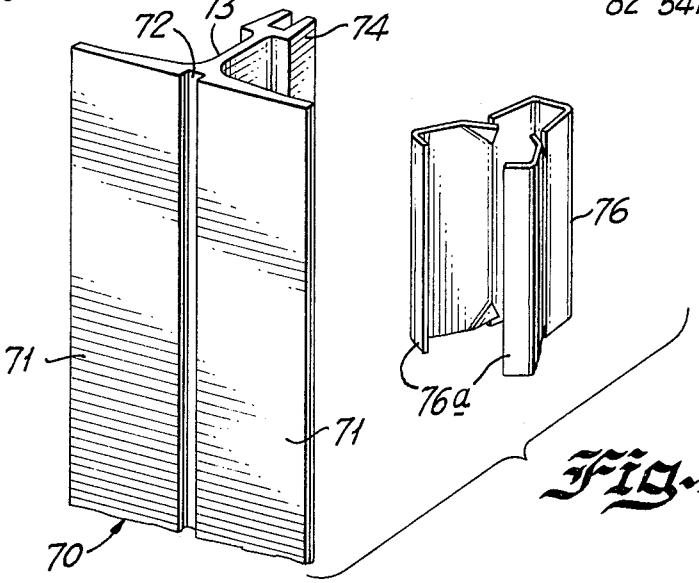
FIG. 13 is a fragmentary perspective elevational view of a joinery element used for joining adjacent panels and illustrating a retaining clip used therewith.

Referring to FIGS. 12 and 13, adjacent edge assemblies 44L and 44R of a pair of panel members 30 disposed in co-planar, side by side relation are interconnected together with a joining element 70 of substantially T-shaped transverse cross-section. The joining element has an outer face comprising a pair of legs 71 extending in opposite directions from a transversely inwardly extending rib or tongue 73 spaced between the legs 64 of the respective corner elements 54L and 54R. The outer edges of the legs 71 of the joining element are adapted to seat within the shoulder recesses 62 on the outside corner of the elements 54L and 54R and when the joining element 70 is fully inserted as shown in FIG. 12, the shoulder recesses 62 together with the legs 71 define grooves similar in appearance to and spaced parallel of the grooves 60 and 35. The outer face of the joining element is also provided with a longitudinal groove 72 at the center thus presenting an appearance generally similar to the outside surface of the panels 30 and making it difficult for a casual observer to detect where the panels are interconnected together.

The tongue 73 of the joining element 70 includes an enlarged bifurcated inner edge portion 74 on which are mounted a plurality of generally U-shaped spaced apart spring clips 76 used for securing the joining element 70 in place to interconnect adjacent panels 30. The U-shaped spring clips are spaced as needed longitudinally along the length of the inner end portion of the tongue 74 and as the tongue is inserted between the corner pockets 66 of a pair of adjacent panel members, the legs 76*a* of the clips are momentarily deflected inwardly until clearing the outer corners of the respective corner elements 54L and 54R. As shown in FIG. 12, the legs 76*a* of the clips are normally biased outwardly and after insertion, the outer ends of the legs engage against inwardly facing locking ribs 78 provided on the elements 54L and 54R thus locking the T-shaped joining element 70 in place to firmly secure adjacent panels in edge to edge co-planar relation as shown in FIG. 12. It is thus seen that once a pair of panel members 30 are set up in side by side co-planar relation with their marginal upper edge portion extending between the downwardly depending flanges of the upper plate member 24 and the marginal lower edge portion of the panels seated and supported between the upwardly extending flanges of the sill members 26, the longitudinal edges of the panels may be rapidly interconnected by inserting the tongue 73 of the T-shaped joining element 70 inwardly into place until the legs 76*a* of the clips are free to spring outwardly and engage and lock against the ribs 78 on the outside elements 54L and 54R of the panel members.

As shown in FIGS. 2 and 11, when glazing panels 32 are positioned adjacent the edge of a panel member 30 rather than another panel member, the marginal edges of the glazing panel 32 is extended into the glazing pocket 52 of the respective edge assemblies 44L and/or 44R and then a snap-in glazing element 80 of generally angular cross-section is inserted for holding the glazing panels firmly in place. The snap-in glazing elements include an outer leg 82 adapted to seat within the shoulder recesses 62 of the outside corner elements 54L and 54R and form therewith a groove similar in appearance and parallel with the grooves 35 and 60. The glazing elements also include an inwardly extending leg 84 having a pocket along the inner edge for holding a sealing gasket 86 for bearing against the outer face of a glazing panel. A similar sealing gasket is carried in a groove provided on the inside edge of the inside corner element 46 to bear and seal against the inside face of the glazing panel.

As shown in the left hand portion of FIG. 2 when the edge of a panel 30 is seated between the flanges of a vertical side frame member 28, a glazing strip 80 is used to fill the panel corner pocket 66 but no sealing gaskets 86 is normally required. As shown in FIG. 10, when a double thick, glazing panel 32A such as insulating glass is utilized, the element 80 is modified somewhat to provide a shorter transverse leg 84 in order to accomodate the increased thickness of the glass. Also it will be seen that the glazing pockets 52 of the respective edge assemblies 44L and 44R are large enough in width to accomodate the extra thickness of the dual glass 32A. The glazing elements 80 are interconnected with the outside corner elements 54L and 54R of the panel edge assemblies by means of a pair of deflectable legs 88 extending parallel of the outside face of the element 82 and formed with enlargements along the outer edges to interlock and seat within grooves provided on the outside corner elements 54L and 54R formed by the rib 78 and a parallel inside rib 90. It will thus be seen that the tongues or legs 88 once snapped into place firmly secure the glazing element 80 in place to hold the glass or other panels in interlocking sealed relation with the adjacent edge assembly 44L or 44R of a panel member 30.

It should also be noted that the outside face portions 82 of the glazing elements are similar in appearance to the land portions between the grooves in the outside face modules 34 the outer legs of the outside corner elements 54L and 54R.

Figure 14:
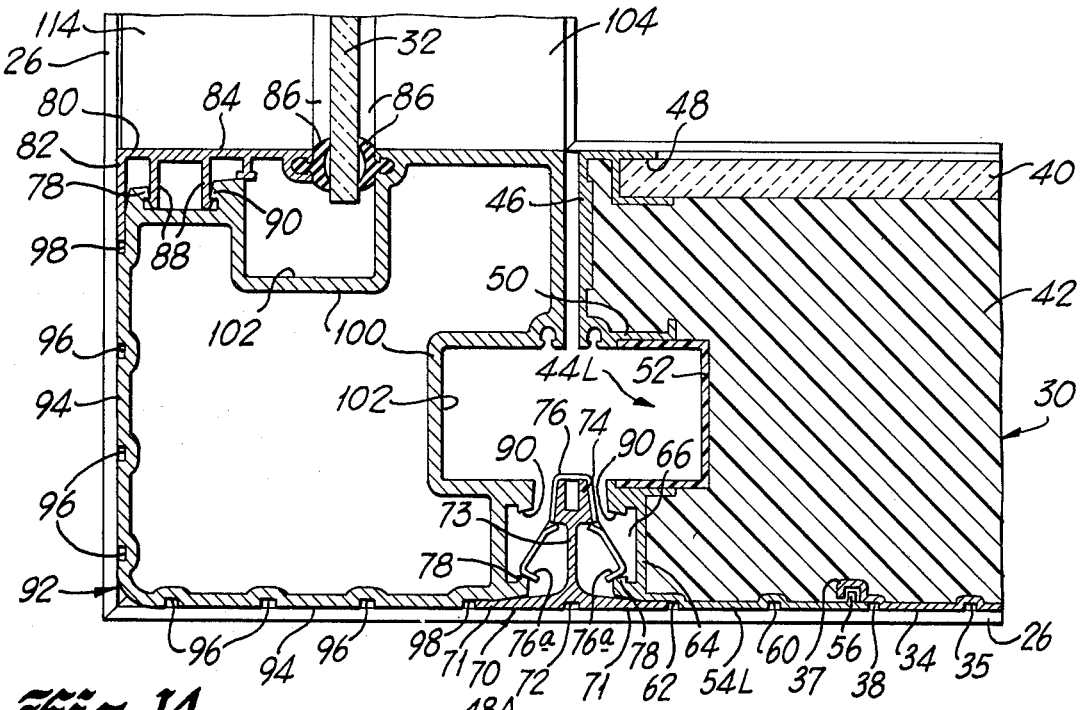
FIG. 14 is a fragmentary, horizontal cross-sectional view taken adjacent the corner of a wall construction in accordance with the present invention and illustrating a novel corner post for angularly interconnecting a pair of walls.

Referring to FIG. 14, the wall construction 20 includes a corner post generally indicated by the numeral 92 adapted to structuraly interconnect a pair of walls disposed at right angles to one another. The corner post preferably is formed in an extrusion process and includes a pair of outside faces 94 having spaced apart grooves 96 in the outer surface similar in appearance, spacing and in longitudinal parallel relation with the grooves 72, 60 and 35 of the other outside face members. In addition, the outer faces 94 are formed with shoulder recesses 98 along opposite outwardly facing edges in order to receive the outside leg 82 of the snap-in glazing element 80 or an outer face portion 71 of the T-shaped joining element 70. When the corner post is thus interconnected, a groove is formed with the recess 98 parallel and similar to the grooves 35, 60 and 72 and it is difficult for a casual observer to perceive that a separate corner post is provided when the whole system is assembled as in FIG. 14. The corner post also includes a pair of intersecting edge walls 100 having profiles similar to the edge assemblies 44L and 44R of the panels 30. As shown in FIG. 14, the profile of the inner edge walls 100 provides a glazing pocket 102 adapted to receive the marginal edge portion of a glazing panel 32 or directly face the glazing opposed pocket 52 in the edge assembly of an adjacent panel 30. Similarly, the inner edge walls 100 are provided with pairs of spaced apart ribs 78 and 90 similar to the ribs on the outside corner members 54L and 54R for interlocking engagement with the legs 76*a* of the clips 76 on the T-shaped joining elements 70 or the legs 88 of the glazing elements 80 as shown.

In accordance with the present invention, the wall system 20 may include panels extending between the members 24 and 26 and the panels may be of any desired width as controlled by the number of modular face elements 34 interposed between the corners 54L and 54R on the opposite edge assemblies 44L and 44R. In FIG. 3 a sectional view is illustrated wherein a panel 30 extends the entire vertical distance between the lower sill member 26 and the upper plate member 24. In the sectional view of FIG. 4, a single glazing element 32 is provided rather than a structural panel 30 to span the entire distance between the sill and plate. In accordance with the present invention, the lower sill 26 is provided with an inside glazing element 104 which is snappingly interlocked with the sill as illustrated and which defines an outwardly opening glazing pocket or recess 106 for accomodating the lower marginal edge portion of the full length glazing panel 32. The upper plate member 24 of the frame is provided with a single glazing element 108 forming an upper glazing pocket 110 for receiving the upper marginal edge of the glass 32. Suitable gaskets 86 are provided on opposite side walls of the upper glazing pocket 110 for sealing against both sides of the glass. The upper edge portion of the glazing panel is inserted upwardly into the pocket 110 and the lower edge portion is then moved inwardly into the recessed shoulder pocket 106 on the lower inside glazing element 104. The edge of the glass is supported on a plurality of glazing blocks 112 spaced at suitable intervals along the bottom wall of the glazing pocket in the glazing member 104. After insertion of the glazing panel in place as described, a snap-in outside glazing element 114 is inserted into place and interlocked with the sill 26 and the inside glazing member 104 as shown in FIG. 6.

Figure 6:
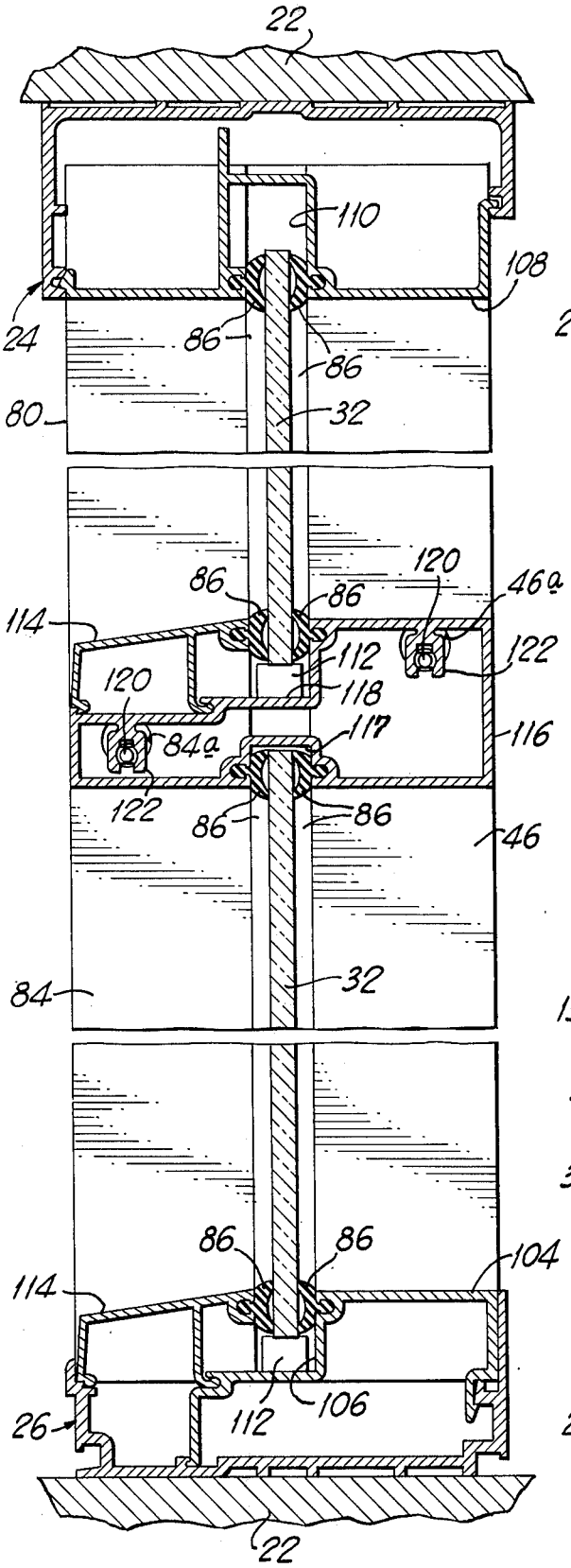
FIG. 6 is a vertical cross-sectional view taken substantially along lines 6—6 of FIG. 1.
Figure 7:
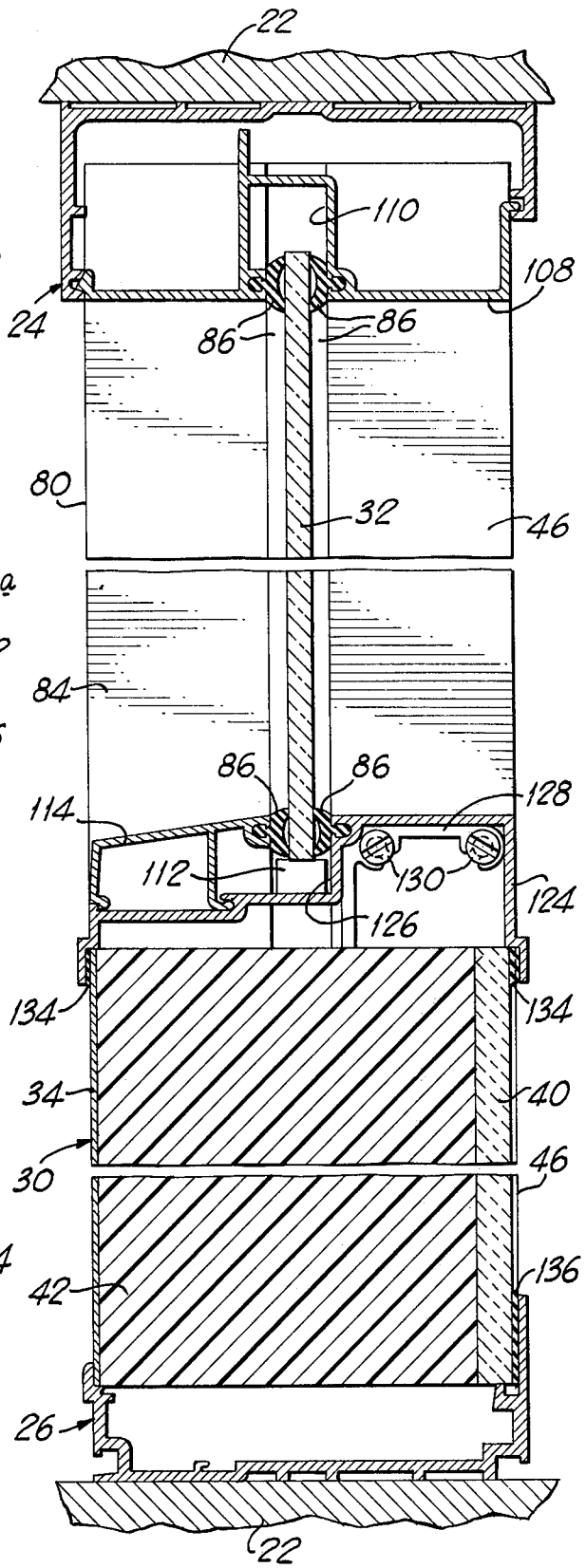
FIG. 7 is a vertical cross-sectional view taken substantially along lines 7—7 of FIG. 1.

Referring to FIGS. 6 and 7, when an intermediate horizontal mullion is desired between a pair of upper and lower glazing panels 32 as shown in FIG. 6, a hollow tubular mullion element 116 having an upper profile similar to the profile of the inside glazing element 104 is provided. The tubular mullion 116 includes a glazing pocket 117 in the lower wall thereof for receiving the upper marginal edge portion of the lower glazing panel 32. Similar to the inside sill glazing element 104, the upper wall portion of the intermediate mullion 116 forms an outwardly facing shoulder recess glazing pocket 118 for receiving the marginal lower edge portion of the upper glazing panel 32 which rests on glazing blocks 112 positioned therein. An outside glazing element 114 identical to the one utilized on the lower sill 26 is snapped into interlocking relation with the tubular mullion 116 to complete the glazing of the upper panel 32 as shown. The intermediate horizontal mullions are cut to appropriate length to fit between verticals and are then inserted between the panels 30 as shown. Each mullion is secured in place by a pair of special fasteners 120 at each end. The fasteners are of the type shown in the copending U.S. Pat. application Ser. No. 279,066, filed Aug. 9, 1972 and reference should be had to this application which is incorporated herein by reference. The shanks of the fasteners extend into pairs of integrally formed screw splines 122 and the fasteners have specially designed heads adapted to be inserted through circular openings **46*a* and 84*a* drilled at appropriate locations in the respective vertical members 46 and 80.** The heads of the fasteners lock the horizontal mullion in place as described in the copending application.

Referring to FIGS. 7, 8 and 9, when a pair of short length insulating structural panel members 30 are set in vertically stacked relation with a glazing panel 32 in between, the wall system 20 includes a pair of spaced apart intermediate horizontal mullions 124 at the sill and head of the glass panel and these mullions include inside and outside vertical flanges adapted to telescope onto the inside and outside faces of the panels 30 inserted therebetween as best shown in FIGS. 7 and 8. The panels 30 are cut to appropriate lengths for the particular size of glazing panel 32 and the intermediate mullions 124 are then inserted in place on the edge of the panel segments which extend therebetween. The mullions 124 are generally channel-shaped in cross-section and define outwardly facing glazing pockets 126. The marginal lower edge of the glass panel 32 is adapted to sit upon glazing blocks 112 carried in the lower glazing pocket 126. Snap-in glazing members 114 are used with the mullion 124 to complete the glazing process and interlock the glass 32 in place.

The mullions 124 are structurally interconnected with the edge assemblies 44L or 44R of panels 30 as best shown in FIGS. 8 and 9 and are secured in place by means of angular support brackets 128 attached to the inside corner elements 46 by means of screws 130 which are inserted into appropriate thread openings. In addition, the mullions 124 are secured to a forward vertical flange of brackets 126 by means of screws 132 which project through countersunk openings **124*a* provided in the vertical wall of the mullion 124. These screws extend into threaded openings 128*a*** formed in the forward vertical flange of the brackets.

Figure 4:
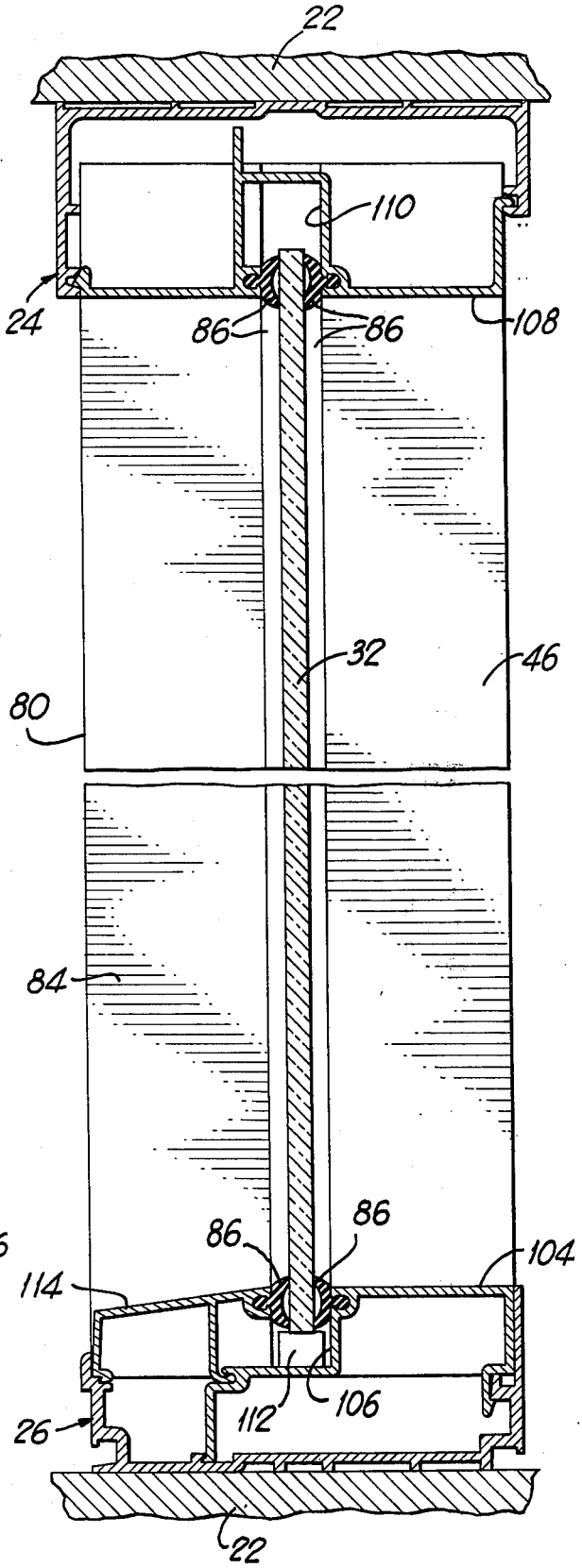
FIG. 4 is a vertical transverse cross-sectional view taken substantially along lines 4—4 of FIG. 1.
Figure 5:
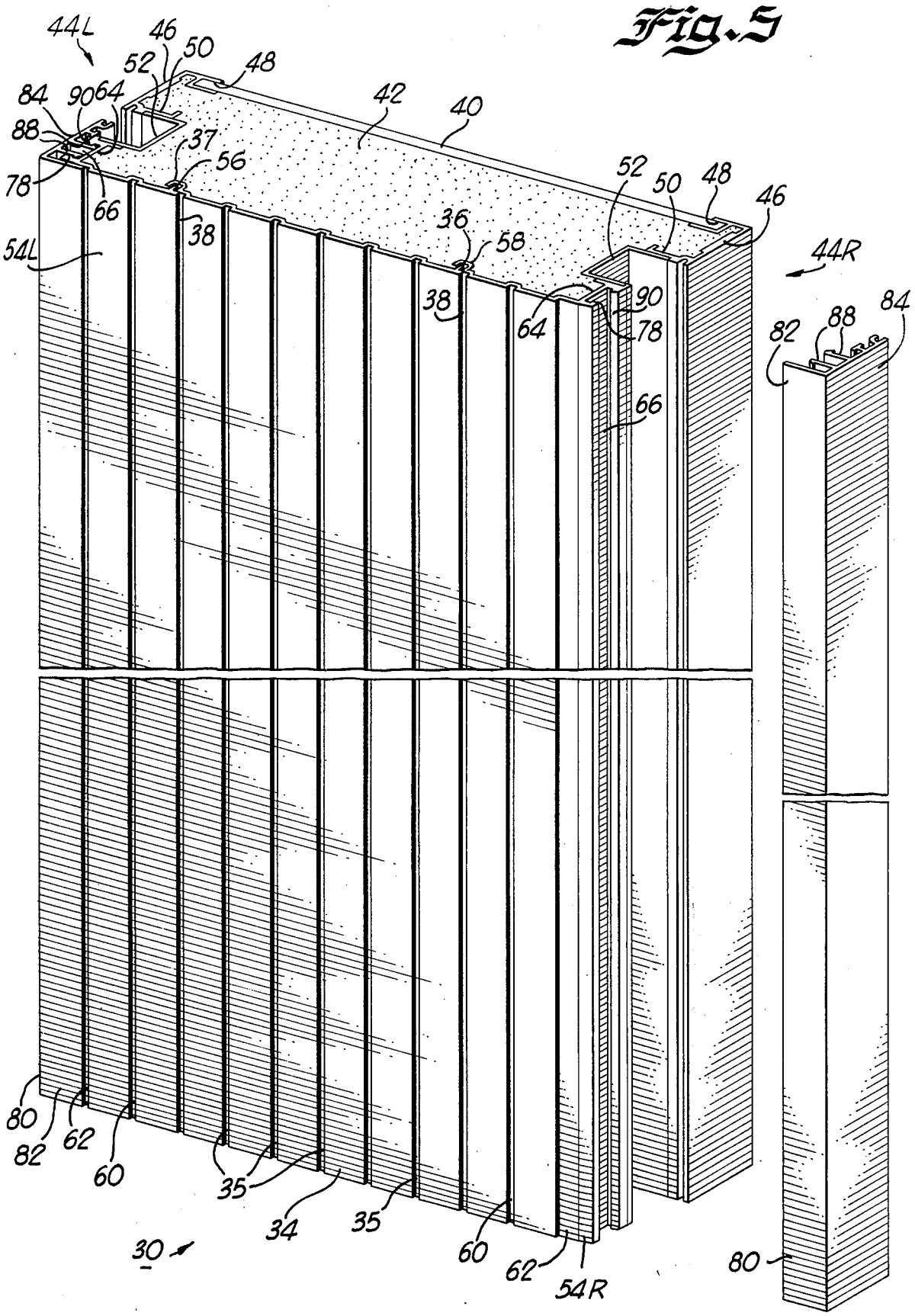
FIG. 5 is a perspective view from the outer side of a novel panel member constructed in accordance with the features of the present invention and showing a snap-in glazing strip separated from the panel and ready to be installed in place.

As shown in FIG. 8 the inside and outside vertical flange of the mullions 124 are in sealing engagement against the inside and outside faces of the respective panel members 30 and suitable sealing gaskets 134 are provided to form weather tight joints. Similar gasket material 136 is provided to seal between the inside surface of the inside panel faces 40 and the inside flange of the lower sill 26, as best shown in FIGS. 4, 7 and 8.

Figure 15:
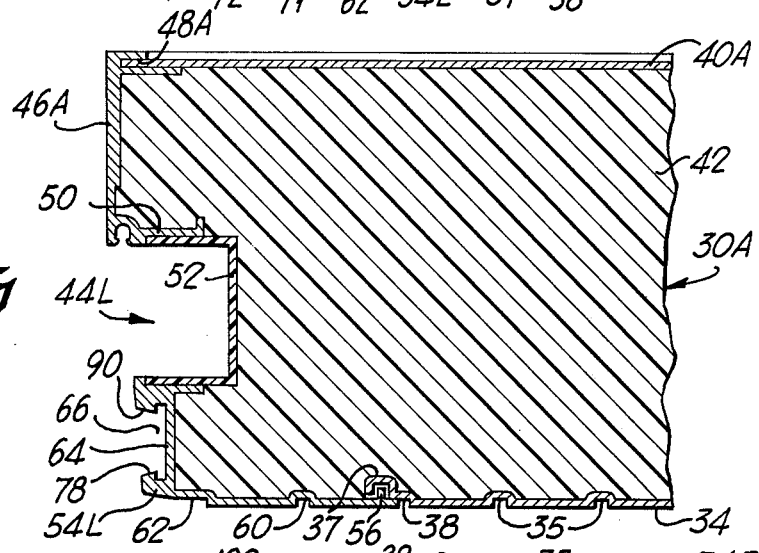
FIG. 15 is a fragmentary horizontal cross-sectional view (similar to FIG. 11) illustrating another embodiment of a panel with a modified type of inside face element in accordance with the present invention.

Referring now to FIG. 15, therein is shown a modified form of structural insulating panel 30A which employs a relatively thin inside panel face 40A of thin sheet material such as aluminum or other metallic sheeting. In this type of panel, the inside corner element 46 of the panel edge assemblies is modified somewhat to provide a groove 48A for receiving the relatively thin inside panel face 40A.

Figure 16:
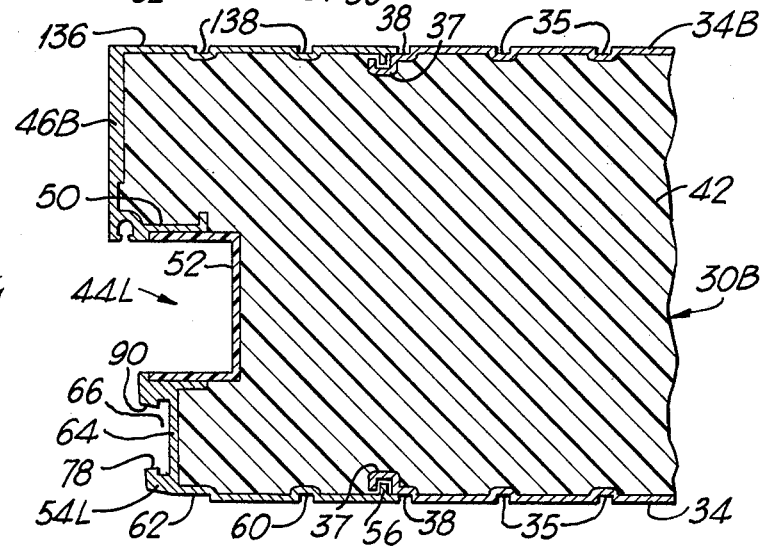
FIG. 16 is a fragmentary horizontal cross-sectional view (similar to FIG. 15) and illustrating yet another embodiment of a panel with a modified inside face element.

FIG. 16 illustrates yet another embodiment of a panel member 30B wherein an inside face element 46B of the edge assembly is modified to include an inner face 136 having grooves 138 formed in the inwardly facing surface thereof. The inner face 136 is adapted for tongue and groove interconnection with one or more modular width, face elements 34B which are identical to the outside modular face elements 34 as previously described. Accordingly, the panel 30B appears similar on both the inside and outside faces.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A wall construction including a panel member having spaced apart inside and outside faces and edge members along opposite longitudinal sides of said panel between said faces; said outside face comprising at least one sheet of weather resistant material having a plurality of spaced apart longitudinal grooves formed in the outer surface thereof and having tongue or groove means along at least one longitudinal edge interfitted with tongue or groove means in at least one of said edge members forming a groove on the outside of said panel parallel of said grooves in said outside face; said one edge member comprising an outside element of generally angular cross-section having an outside leg interfitted with said tongue or groove means of said outside face and a transverse leg extending inwardly of said outer face, an inside element having a leg extended transversely outwardly of said inside face and interconnected therewith, and a glazing pocket element of channel shaped cross-section having a pair of spaced apart legs on opposite sides of a web portion and transverse thereof, said pocket element legs being interconnected with said transverse leg of said outside element and said leg of said inside element; and structural foam insulation means secured between said inside and outside faces and engaging inner surfaces of said edge members.

2. The wall construction of claim 1 wherein said pocket element is formed of non-metalic heat insulating material.

3. The wall construction of claim 1 wherein said transverse leg of said outside element and said leg of said inside element are offset from one another forming an outwardly facing corner pocket along the longitudinal edge of said panel member, and a snap-in filler element of generally angular cross-section for enclosing said corner pocket and forming a glazing stop for a glazing panel extending into said glazing pocket.

4. The wall construction of claim 1 wherein said outside leg of said outside element has at least one longitudinally extending groove in the outer surface thereof parallel and matching said grooves in said outer face.

5. The wall construction of claim 3 wherein said snap-in filler element includes an outside leg having an edge forming a tongue and groove joint with said outside leg of said outside element.

6. A wall construction comprising a pair of panel members as set forth in claim 1 disposed in side by side co-planar relation with an edge member of each panel in facing adjacent relation with the edge member of the other panel, a batten member for interconnecting said panels including an outside strip having opposite edges in tongue and groove relation with the outside elements of said adjacent panel edge members and an inwardly projecting tongue transverse of said strip, and clip means for securing said tongue in place between said adjacent panel edge members.

7. The wall construction of claim 6 wherein said opposite edges of said strip and adjacent portions of said adjacent panel edge members form a pair of grooves parallel and matching said grooves in said outside face.

8. The wall construction of claim 1 wherein said outside face includes a plurality of face members having a modular transverse width dimension, and grooves formed in the outer surface thereof, and tongue and groove means interlocking together at least one pair of said face members along adjacent longitudinal edges.

9. The wall construction of claim 1 wherein said tongue and groove means includes a tongue extending transversely inwardly of said outer face of said panel member and includes a groove member of U-shaped cross-section having legs extending transversely inwardly of said outer face of said panel member.

10. The wall construction of claim 8 wherein said tongue and groove means includes a tongue extending transversely inwardly of said outer face of said panel member and includes a groove member of U-shaped cross-section having legs extending transversely inwardly of said outer face of said panel member.

11. The wall construction of claim 1 wherein said inside element of said one edge members includes inwardly facing groove means adjacent the inside edge of said leg, said inside face of said panel member including a marginal longitudinal edge portion extending into said groove means.

12. A wall construction comprising a pair of panel members as set forth in claim 1 positioned on angularly intersecting planes with their edge members closely adjacent along the inside edge of the legs of their inside elements and a corner post having a pair of angularly intersecting outside faces co-planar with the outside faces of the respective panel members and having longitudinal grooves therein parallel of said grooves in said outside faces of said panels, said post having inwardly extending edge walls intersecting at an inside corner adjacent said inside edges of said inside elements of said panel members, said inwardly extending edge walls having glazing pockets of channel shaped cross-section defined therein directly facing said glazing pockets in the respective edge members of said panel members.

13. The wall construction of claim 12 including a batten member for interconnecting the outside face of at least one panel member with the co-planar outside face of said corner post, said batten having an outside strip with opposite longitudinal edges in tongue and groove relation with adjacent edges of the outside face of said corner post and panel member and an inwardly projecting tongue transverse of said strip and clip means for securing said tongue in place between the edge member of said panel and the facing edge wall of said corner post.

14. The wall construction of claim 12 wherein at least one edge wall of said corner post forms an outwardly facing corner pocket in communication with the adjacent glazing pocket thereof, and a snap-in filler element of generally angular cross-section for enclosing said corner pocket.

15. The wall construction of claim 14 wherein said snap-in filler element includes an outside leg having an edge forming a tongue and groove joint with the adjacent outside face of said corner post.

16. A unitary prefabricated structural wall panel unit comprising:

a pair of spaced apart inside and outside surface panels, rigid insulation means secured to opposite inside facing surfaces of said panels for structurally interconnecting the same; and a pair of structural mullion elements interconnected to opposite longitudinal edges of said inside and outside panels and secured to said rigid insulation, said structural mullion elements including panel unit edge connector means adapted for interconnection with another of said wall panel units positioned in edge to edge relation adjacent thereto.

17. The wall panel unit of claim 16 wherein said outer panel comprises at least one panel element with tongue and groove means along opposite edges for interconnection with an adjacent panel element and/or a structural mullion element.

18. The wall panel unit of claim 16 wherein said structural mullion elements comprise a recessed central channel portion for receiving a glazing panel or the like and a pair of corner elements on opposite sides of said channel portion, each interconnected with an adjacent edge of a surface panel.

19. The wall panel of claim 18 wherein an outer one of said corner elements includes an outer surface portion aligned with the outer surface of said outer surface panel and interconnected with an adjacent edge thereof.

20. The wall panel of claim 19 wherein an inner one of said corner elements includes a groove for receiving an edge portion of said inner surface panel.

21. The wall panel of claim 16 wherein said insulation means comprises a closed cell light weight foam material.

22. The wall panel unit of claim 18 wherein said corner elements have legs transverse to said surface panels and are offset from one another forming an outwardly facing corner pocket along the longitudinal edge of said panel unit, and a snap-in filler element of generally angular cross-section for enclosing said corner pocket and forming a glazing stop for a glazing panel extending into said channel portion.

23. A wall construction comprising a pair of panel units as set forth in claim 18 disposed in side by side co-planar relation with a mullion element of each panel unit in facing adjacent relation with a mullion element of the other panel unit, a batten member for interconnecting said panel units including an outside strip having opposite edges in tongue and groove relation with outside corner elements of said facing mullion elements and an inwardly projecting tongue transverse of said strip, and clip means for securing said tongue in place between said adjacent mullion elements.

24. The wall panel unit of claim 17 wherein said outside surface panel includes a plurality of said panel elements having a modular transverse width dimension, and grooves formed in the outer surface thereof, and tongue and groove means interlocking together at least one pair of said panel elements along their adjacent longitudinal edges.

25. A wall construction comprising a pair of panel units as set forth in claim 18 positioned on angularly intersecting planes with their mullion elements closely adjacent along inside corner elements and a corner post having a pair of angularly intersecting outside faces aligned with the outside panels of the respective panel units, said post having inwardly extending edge walls intersecting at an inside corner adjacent said inside corner elements of said panel units, said inwardly extending edge walls having glazing pockets of channel shaped cross-section defined therein directly facing said channel portions in the respective mullion elements of said panel units.

26. The wall construction of claim 25 including a batten member for interconnecting the outside panels of at least one panel unit with the aligned outside face of said corner post, said batten having an outside strip with opposite longitudinal edges in tongue and groove relation with adjacent portions of the outside face of said corner post and outside panel and an inwardly projecting tongue transverse of said strip, and clip means for securing said tongue in place between the mullion element of said panel unit and the facing edge wall of said corner post.

27. The wall construction of claim 25 wherein at least one edge wall of said corner post forms an outwardly facing corner pocket in communication with the adjacent glazing pocket thereof, and a snap-in filler element of generally angular cross-section for enclosing said corner pocket.

28. The wall construction of claim 27 wherein said snap-in filler element includes an outside leg having an edge forming a tongue and groove joint with the adjacent outside face of said corner post.

* * * * *